US007223070B2

(12) United States Patent
Tam et al.

(10) Patent No.: US 7,223,070 B2
(45) Date of Patent: May 29, 2007

(54) BLOWER MOTOR

(75) Inventors: Siu Chun Tam, Hong Kong (CN); Gary M. Marcy, Rochester, NY (US)

(73) Assignee: Johnson Electric S.A., La Chaux-de-Fonds (CH)

( * ) Notice: Subject to any disclaimer, the term of this patent is extended or adjusted under 35 U.S.C. 154(b) by 356 days.

(21) Appl. No.: 11/002,304

(22) Filed: Dec. 3, 2004

(65) Prior Publication Data

US 2005/0123398 A1 Jun. 9, 2005

(30) Foreign Application Priority Data

Dec. 6, 2003 (GB) ..... 0328384.3

(51) Int. Cl.
*F04D 29/44* (2006.01)

(52) U.S. Cl. ..... 415/208.3; 415/211.2

(58) Field of Classification Search ..... 415/208.2, 415/208.3, 211.2; 417/423.2; 15/412
See application file for complete search history.

(56) References Cited

U.S. PATENT DOCUMENTS 4,679,990 A 7/1987 Yamaura et al.
5,110,266 A * 5/1992 Toyoshima et al. ..... 417/423.2

FOREIGN PATENT DOCUMENTS

| | | | |
|---|---|---|---|
| DE | 297 17 906 | | 3/1999 |
| EP | 0 385 298 | A2 | 4/1990 |
| EP | 0 556 895 | A1 | 8/1993 |
| EP | 1 048 258 | A2 | 11/2000 |
| EP | 1 297 772 | A2 | 4/2003 |
| JP | 2000-291592 | A | 10/2000 |
| JP | 2000291592 | A * | 10/2000 |
| JP | 2001-304172 | A | 10/2001 |
| JP | 2003-49799 | A | 3/2003 |
| WO | WO-97/30621 | A1 | 8/1997 |

* cited by examiner

*Primary Examiner*—Richard A. Edgar
(74) *Attorney, Agent, or Firm*—Birch, Stewart, Kolasch & Birch, LLP

(57) ABSTRACT

A blower motor for a vacuum cleaner or the like has an impeller/rotor assembly which is dynamically balanced. Air guide vanes are disposed between the diffuser plate and fan cover and surround the impeller periphery. A fan cover 13 accommodates the impeller 12. A vane plate 14 is fitted to the fan cover 13 for easy assembly and has guide vanes 28 which locate about the impeller 12 for guiding the working air from the impeller to a diffuser plate.

11 Claims, 5 Drawing Sheets

BLOWER MOTOR

CROSS-REFERENCE TO RELATED APPLICATIONS

This non-provisional patent application claims priority under 35 U.S.C. § 119(a) from Patent Application No. 0328384.3 filed in Great Britain on Dec. 6, 2003.

FIELD OF THE INVENTION

This invention relates to a blower motor for a vacuum cleaner and the like and the improvement is applicable to both flow through and bypass type blower motors.

PRIOR ART

Blower motors for vacuum cleaners and the like are well known and fall generally into two types, the flow through type where working air is blown over and through the electric motor and the bypass type where the working air does not directly cool the motor, requiring a separate cooling system for the motor. However, the principle of operation is more or less the same. The motor, usually a universal motor but may be a d.c. motor, either with or without brushes, has a stator, a rotor, a motor body or housing and a diffuser plate. A fan cover is fitted to the motor. The motor drives a centrifugal type fan, known as the impeller, at high speed to create a vacuum at the inlet to the fan cover and expels the air through vents either in the fan cover in the case of the bypass blower or in the diffuser plate in the case of the flow through blower.

The efficiency of the blower depends on how efficiently the air can be moved from the inlet to the exhaust vents. Early designs used an impeller which was located axially separated from the diffuser plate within the fan cover. This has been improved by adding vanes to the diffuser plate which extend axially into the area along side or radially of the impeller to direct air flow from the impeller to the exhaust vents reducing swirling and turbulence in the void between the impeller and fan cover.

This increased the efficiency of the blower over all but complicated the assembly. As the motor operates at high speed, e.g. in some applications, up to 45,000 rpm, it is important that the motor and impeller are balanced to avoid severe vibrations. This is done by balancing the rotor during manufacture of the rotor and then by dynamically balancing the rotor and impeller combination when the impeller is fitted to the motor before the fan cover is installed. Balancing is effected by removing a small amount of material from an outer edge of the impeller at the correct location. However, with the additional vanes on the diffuser plate, the nibbing tool or cutter cannot gain access to the edge of the impeller to balance the rotor/impeller assembly. One solution is to leave a gap in the vanes to allow the tool access to the impeller, but this adversely affects the performance or efficiency of the air flow path. Another way, as shown in JP 2003-49799A and JP 2000-291592A by Toshiba Tec Corp., is to make the vanes a separate item which is installed after balancing and before the fan cover is fitted. This approach gives the best result but these two methods complicate the design and slow down the assembly of the final blower due to added parts which must be carefully fitted to the diffuser plate, otherwise the fan cover will not be properly seated.

BRIEF SUMMARY OF THE INVENTION

Accordingly, it is desired to have a blower for a vacuum cleaner or the like, in which air guide vanes are provided adjacent the impeller, which do not interfere with dynamic balancing of the rotor/impeller assembly and is easy to assemble (in either a flow through or bypass arrangement.)

The present invention achieves this by providing the air guide vanes as part of the fan cover. This is achieved preferably by use of a separate molded part fitted to the fan cover. The fan cover and vanes may or may not be keyed together, but there is no direct keying between the vanes and the diffuser although the fan cover could be keyed to the diffuser or a motor housing part.

Accordingly, the present invention provides a blower motor assembly comprising: a motor assembly, including a housing and having a stator and a rotor carried by the housing; and a working air fan assembly coupled to the housing and having an axial inlet and at least one exhaust outlet, the fan assembly having a cup shaped fan cover having a hole forming the inlet, a centrifugal fan fixed to the rotor for rotation therewith, a diffuser plate for guiding the working air to the at least one exhaust outlet and a vane plate for guiding the working air from the fan to the diffuser plate, the vane plate having an annular plate and a plurality of vanes located about the radial periphery of the fan; characterized in that the vane plate is fixed to the fan cover as a press fit against a circumferential wall of the fan cover and is nipped between the diffuser plate and a base of the fan cover to prevent axial movement.

Preferably, the base of the fan cover has at least one inwardly extending projection and the vane plate has a respective recess which engages the at least one projection to key the vane plate to the fan cover.

Preferably, the fan cover is keyed to a part of the motor assembly to circumferentially align the vanes of the vane plate with passages of the diffuser plate.

Preferably, the vane plate has an annular base portion from which the vanes depend axially, the base portion having a plurality of radially extending projections spaced about its peripheral edge which engage and grip the fan cover.

Preferably, the fan cover is a drawn metal part and the projections are stamped into the base forming blind holes in the outer surface of the fan cover, said blind holes not penetrating through the fan cover.

Preferably, the diffuser plate has a plurality of passageways for directing the working air from the vanes to the at least one exhaust outlet.

Preferably, wherein the passageways of the diffuser plate extend from one side of the diffuser plate to the other side and direct the working air from the fan cover and into the motor housing to cool the motor.

Preferably, the at least one exhaust outlet comprises a plurality of apertures formed in the cylindrical wall of the cup shaped fan cover and the passageways of the diffuser plate direct the working air towards and out the apertures.

Preferably, the apertures are axially spaced from the fan cover and the passageways direct the air axially and radially outward.

Alternatively, the vane plate could be integrally formed with the fan cover, preferably as a single monolithic molding.

BRIEF DESCRIPTION OF THE DRAWINGS

Two preferred embodiments of the invention will now be described, by way of example only, with reference to the accompanying drawings in which.

DETAILED DESCRIPTION OF THE PREFERRED EMBODIMENT

Figure 1:
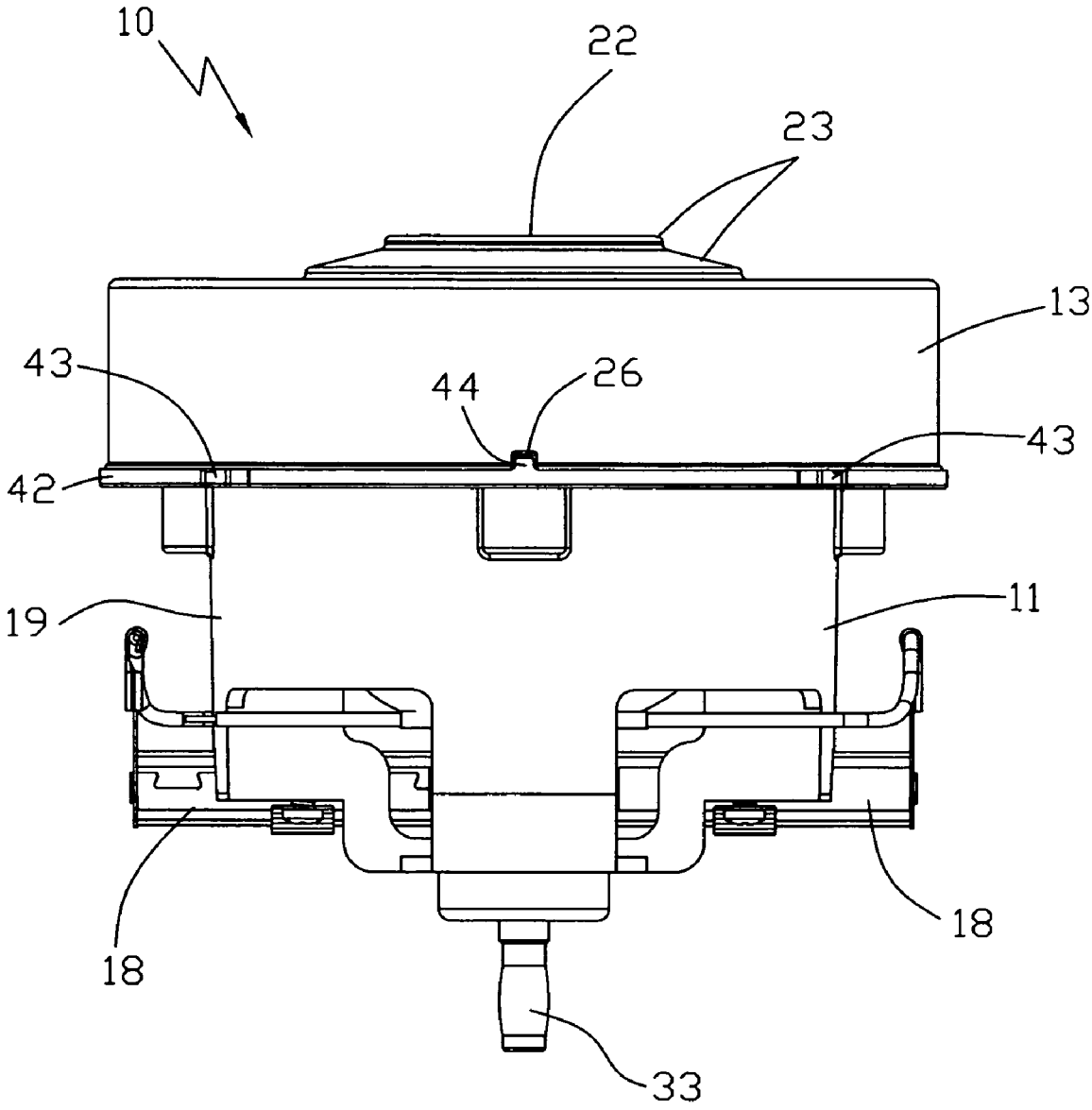
FIG. 1 is an elevational view of a blower motor to which the present invention is applicable.

FIG. 1 illustrates a flow through blower motor 10 of the universal motor type as used, for example, in vacuum cleaners, garden blowers and other appliances requiring the creation of a vacuum or the movement of air under pressure.

Figure 2:
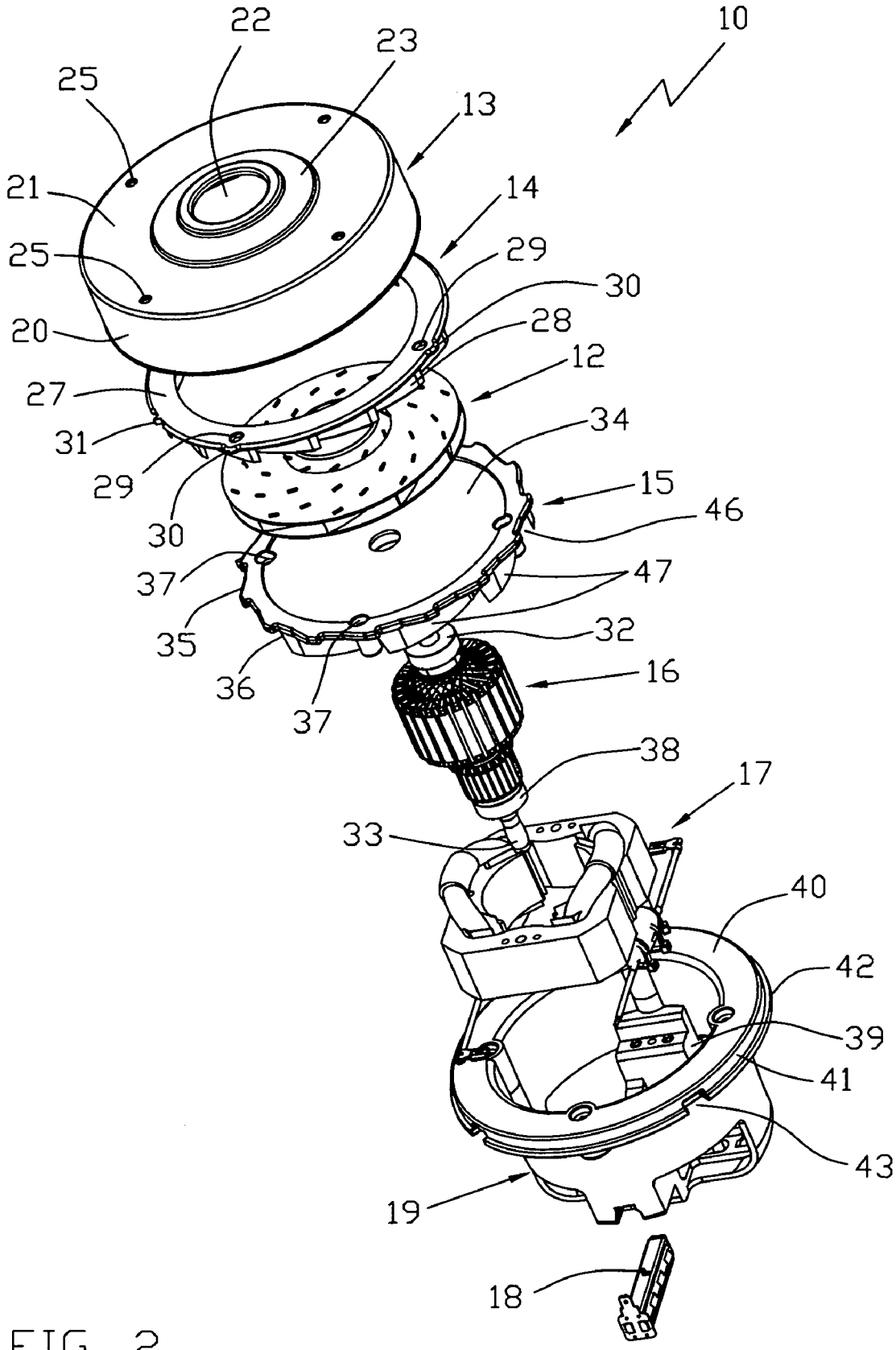
FIG. 2 is an exploded view of the motor of FIG. 1.
Figure 3:
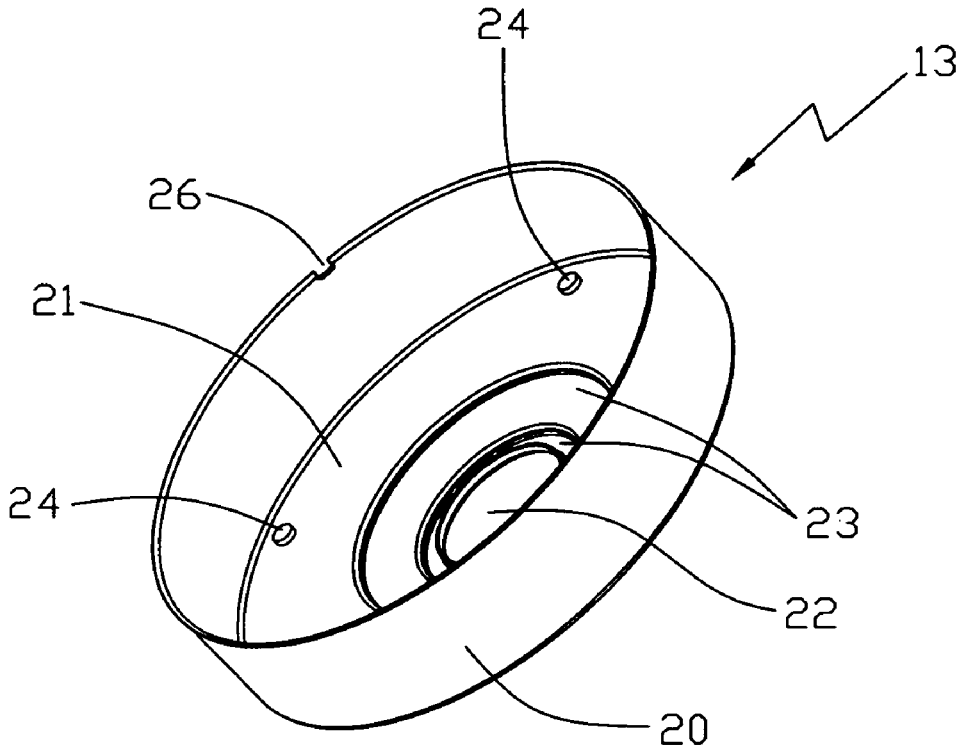
FIG. 3 is a perspective view of a fan cover of the motor of FIG. 2.

The blower 10 has a motor which drives an impeller. In FIG. 1, the motor 11 and a fan cover 13 are visible. FIG. 2 is an exploded view of the blower 10. From the top of FIG. 2, the blower has a fan cover 13, a vane plate 14, an impeller 12, a diffuser plate 15, a rotor 16, a stator 17, brush assemblies 18 and a motor rear housing 19.

The fan cover 13 is a drawn metal part having a cylindrical wall 20 and one closed end 21. The closed end 21 has a central opening forming the inlet 22 for the blower. The closed end 21 is shown substantially flat with a series of raised rings 23 concentric with and adjacent the inlet 22. The closed end 21 also has four equally spaced round depressions 25 formed by stamping. These depressions form closed or blind holes in the outer surface of the cover 13 and raised projections 24 on the inner surface of the end wall 21. Being blind holes, the cover 13 does not lose its air tightness in this region.

The projections 24 form keys to align the vane plate 14 with the fan cover. A cutout 26 is formed in the free edge of the cylindrical wall 20 for keying the cover 13 to the body of the motor, e.g., to the motor housing 19 or the diffuser plate 15.

The vane plate 14 is a plastics material molding, preferably of nylon. It has a plate like ring 27 with air guiding vanes 28 depending from the lower surface of the ring 27. The ring 27 has four holes 29 which may be blind holes, which align with and receive the four projections 24 in the inner surface of the fan cover 13. These serve to rotationally lock and key the vane plate 14 to the fan cover 13. The ring 27 also has four radial projections 30 extending from the outer periphery of the ring 27 adjacent the holes 29. These projections 30 form an interference fit within the fan cover 13 and hold the vane plate 14 to the cover 13. A fifth projection 31 is also provided which is used during assembly to align the plate 14 with the fan cover 13. Once the vane plate 14 is pressed into the fan cover 13, the fan cover 13 and vane plate 14 become one part for final assembly. When assembled, the vanes 28 enclose the outer periphery of the impeller 12.

The impeller 12 is a standard single stage centrifugal fan assembly used in blower motors. The impeller 12 has an inlet which is aligned with the fan cover inlet 22 and depending on the application, the impeller inlet may or may not engage a seal (not shown) fitted to the fan cover 13 about the inlet 22.

The diffuser plate 15 forms an upper end of the motor housing and supports a bearing 32 for the motor shaft 33 as is commonly known. The diffuser 15 has a substantially flat upper surface 34 facing the impeller 12. In this embodiment, the blower is of the flow through type and the diffuser 15 has an outer edge 35 which intermittently contacts the fan cover 13 at circumferentially spaced locations. In between the contact points are openings 36 between the fan cover 13 and the diffuser plate 15 forming outlets for passing the working air from the impeller 12 into the motor housing.

The motor housing comprises the diffuser plate 15 as mentioned above and a rear housing 19. The diffuser plate 15 is attached to the motor housing 19 by four screws (not shown) passing through holes 37 (three only visible) in the diffuser plate 15 adjacent the outer periphery. In this embodiment, the rear housing 19 has a cup like appearance with an open end which mates with the diffuser plate 15 and a semi-enclosed end which supports a second bearing 38 for the motor shaft. The rear housing 19 supports the stator core 17 of the motor. One of two projections 34 for mounting the stator core is visible in FIG. 2.

The open end of the rear housing 19 has a flange 40. The flange 40 abuts the diffuser plate 15 or more precisely, a plurality of air guide vanes 47 formed on the lower surface of the diffuser plate 15 and forming air passageways 46 for the working air. The flange 40 also receives the open end of the fan cover 13. The fan cover 13 is pressed onto a wall or outer edge 41 of the flange 40 which has an axial extent sufficient to form a substantially air tight seal or seat between the flange 40 and the fan cover 13. A ridge 42 is formed on the outer periphery of the flange to correctly position the fan cover 13 axially. Four recesses 43 in the flange wall 41 and ridge 42 allow the fan cover 13 to be crimped to the rear housing 19 to prevent removal and/or separation. A projection or alignment block 44 is formed on the wall of the flange 40 for mating with the cutout 26 in the open end of the fan cover 13 to circumferentially align the cover 13 with the motor housing 19. This is only important if the design of the vane plate 14 is such that it should be physically aligned rotationally or circumferentially with the diffuser plate 15 as there is no provision to directly align the vane plate 14 with the diffuser plate 15.

In assembling the blower, the rotor 16 is manufactured and balanced, the stator 17 and brush cage assemblies 18 are fitted to the rear housing 19. The rotor 16 and bearings 38, 32 are fitted to the rear housing 19 and the diffuser plate 15 and the diffuser plate 15 is fixed to the rear housing 19. The impeller 12 is then fitted to the motor shaft 22 and the motor is dynamically balanced. The fan cover 13, complete with the vane plate 14 is fitted to the motor and crimped to the flange 40 completing the blower.

In fitting the cover 13, the vane plate 14 is squeezed between or nipped by the fan cover 13 and the diffuser plate 15 preventing any movement of the vane plate.

Hence, the present invention provides an easy to assemble and dynamically balanceable blower with impeller guide vanes for a vacuum cleaner or the like.

Figure 6:
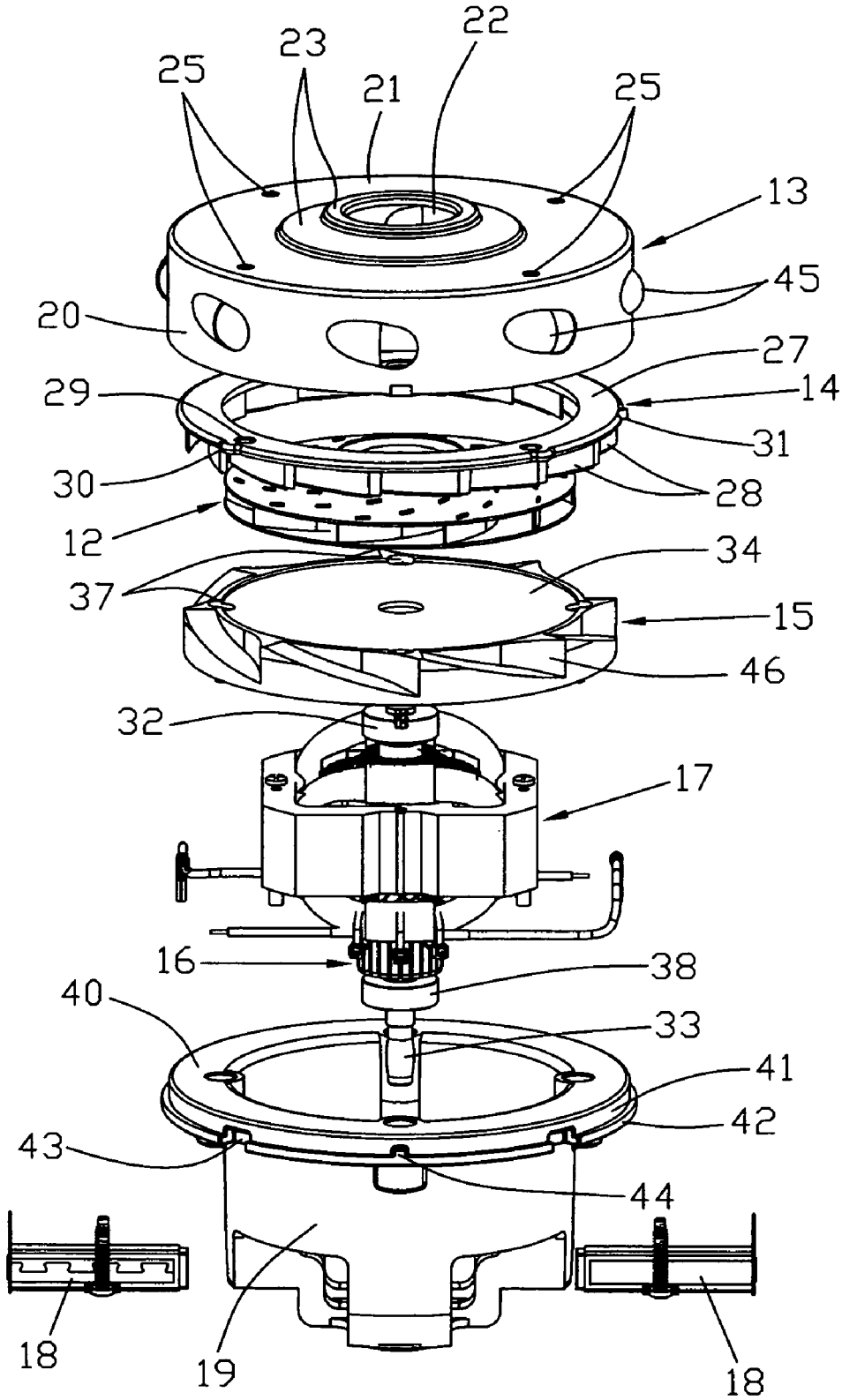
FIG. 6 is a view similar to FIG. 2 of a blower motor according to a second embodiment.

A second embodiment is shown in FIG. 6. In this embodiment the blower is a bypass type blower in which the working air bypasses the motor section of the blower. The fan cover 13 has a plurality of apertures 45 forming the exhaust outlets formed in its cylindrical wall 20. The diffuser plate 15 has a plurality of open passageways 45 which direct the working air axially downward and radially outward through the exhaust apertures 45. The vane plate 14 is the same as in the first embodiment directing the air flow from the impeller 12 and into the passageways 46 formed in the diffuser plate 15. The vane plate 14 is attached to the fan cover 13 in the same manner as used in the first embodiment. The two embodiments are essentially the same with the exception of the exhaust outlets or apertures 45 in the fan cover 13 and a slightly reconfigured diffuser plate 15. A cooling fan (not shown) would be added to the motor shaft 33 to provide a separate flow of air to cool the motor. This type of motor is often used in wet and dry vacuum cleaners and carpet shampooing apparatus.

The embodiments described above are given by way of example only and various modifications will be apparent to persons skilled in the art without departing from the scope of the invention as defined in the appended claims.

Figure 7:
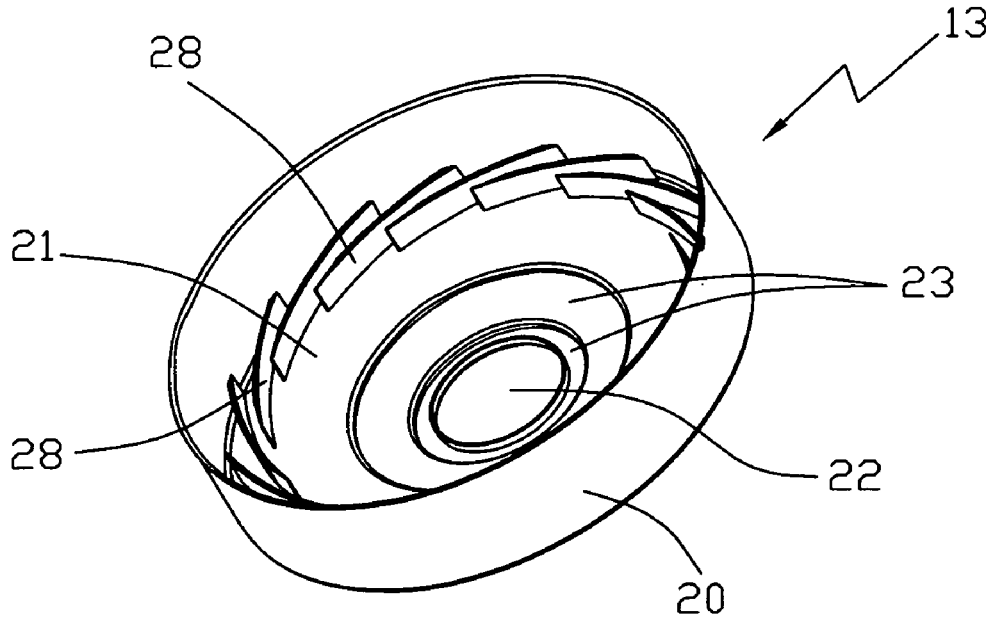
FIG. 7 is a perspective view of an alternative fan cover.
Figure 4:
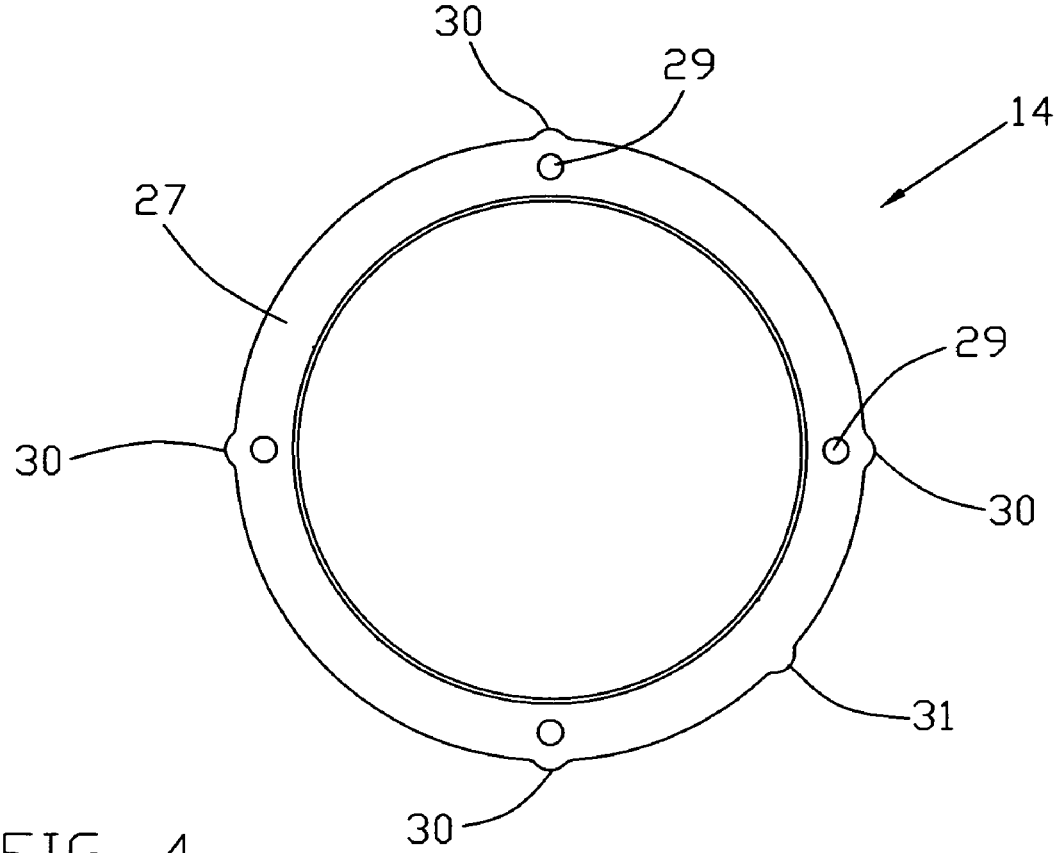
FIG. 4 is a plan view of a vane plate of the motor of FIG. 2.
Figure 5:
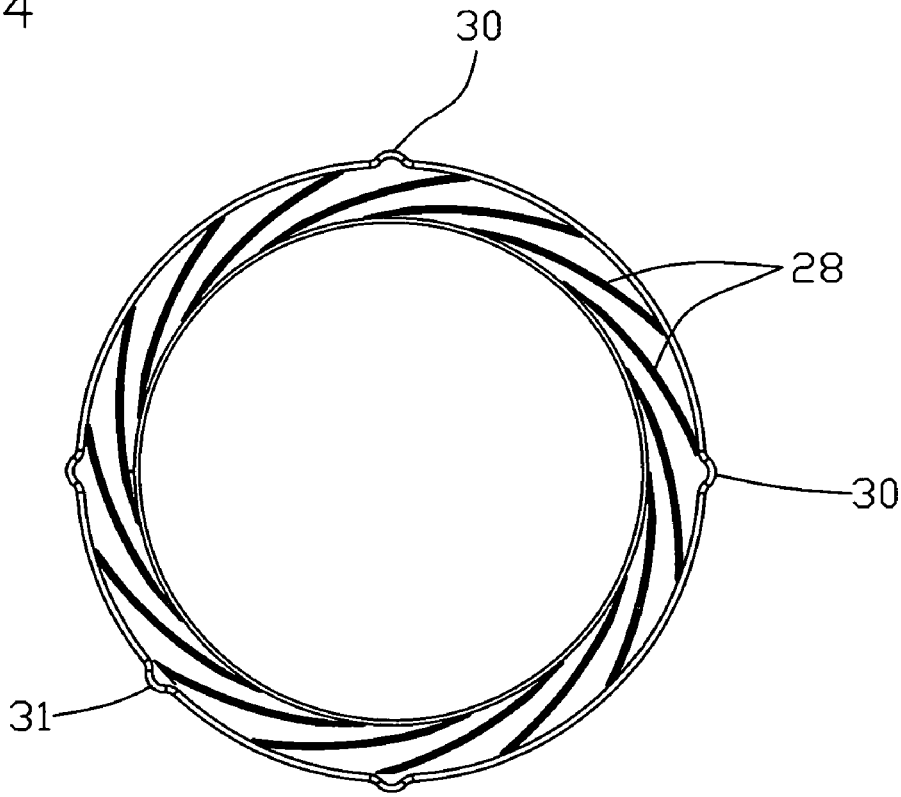
FIG. 5 is a view from below of the vane plate of FIG. 4.

For example, the fan cover 13 and the vane plate 27 could be formed integrally, preferably made as a monolithic molding, preferably of a heat resistant resin material such as BMC, nylon or the like. Such an alternative is shown in FIG. 7 where the fan cover 13 has integrally molded air guide vanes 28 extending inwardly of the fan cover 13, both from the base 21 and from the cylindrical wall 20 to provide rigid support for the individual vanes. As such, projections 24 and blind holes 25 are not required in this embodiment.

The invention claimed is:

1. A blower motor assembly comprising:

a motor assembly, including a housing and having a stator and a rotor carried by the housing; and a working air fan assembly coupled to the housing and having an axial inlet and at least one exhaust outlet, the fan assembly having a cup shaped fan cover having a hole forming the inlet, a centrifugal fan fixed to the rotor for rotation therewith, a diffuser plate for guiding the working air to the at least one exhaust outlet and a vane plate for guiding the working air from the fan to the diffuser plate, the vane plate having a plurality of vanes located about the radial periphery of the fan;

characterized in that the vane plate is fixed to the fan cover as a press fit against a cylindrical wall of the fan cover and is nipped between the diffuser plate and a base of the fan cover to prevent axial movement.

2. The blower motor assembly of claim 1 wherein the base of the fan cover has at least one inwardly extending projection and the vane plate has a respective recess which engages the at least one projection to key the vane plate to the fan cover.

3. The blower motor assembly of claim 2 wherein the fan cover is keyed to a part of the motor assembly to circumferentially align the vanes of the vane plate with passages of the diffuser plate.

4. The blower motor assembly of claim 1 wherein the vane plate has an annular base portion from which the vanes depend axially, the base portion having a plurality of radially extending projections spaced about its peripheral edge which engage and grip the fan cover.

5. The blower motor assembly of claim 2 wherein the fan cover is a drawn metal part and the projections are stamped into the base forming blind holes in the outer surface of the fan cover, said blind holes not penetrating through the fan cover.

6. The assembly of claim 1 wherein the diffuser plate has a plurality of passageways for directing the working air from the vanes to the at least one exhaust outlet.

7. The assembly of claim 6 wherein the passageways of the diffuser plate extend from one side of the diffuser plate to the other side and direct the working air from the fan cover and into the motor housing to cool the motor.

8. The assembly of claim 6 wherein the at least one exhaust outlet comprises a plurality of apertures formed in the cylindrical wall of the cup shaped fan cover and the passageways of the diffuser plate direct the working air towards and out the apertures.

9. The assembly of claim 8 wherein the apertures are axially spaced from the fan cover and the passageways direct the air axially and radially outward.

10. A blower motor assembly comprising:

a motor assembly, including a housing and having a stator and a rotor carried by the housing; and a working air fan assembly coupled to the housing and having an axial inlet and at least one exhaust outlet, the fan assembly having a cup-shaped fan cover having a hole forming the inlet, a centrifugal fan fixed to the rotor for rotation therewith, a diffuser for guiding the working air to the at least one exhaust outlet and a plurality of vanes located about the radial periphery of the fan, the vanes being integral with and extending from the fan cover.

11. The blower motor assembly of claim 10 wherein the fan cover and the plurality of vanes are a single monolithic molding.

* * * * *